United States Patent [19]

Weizer et al.

[11] Patent Number: 4,924,783

[45] Date of Patent: May 15, 1990

[54] KNOCK-DOWN STACKABLE CONTAINER

[75] Inventors: Thomas C. Weizer, South Russell; Thomas P. Cerjak, Mentor, both of Ohio

[73] Assignee: AXIA, Inc., Oak Brook, Ill.

[21] Appl. No.: 344,205

[22] Filed: Apr. 27, 1989

[51] Int. Cl.[5] ..... B65D 19/38

[52] U.S. Cl. ..... 108/53.3; 211/194; 108/53.5; 403/341

[58] Field of Search ..... 403/341, 305, 300, 334; 285/331, 398, 371; 108/53.3, 53.5; 211/194

[56] References Cited

U.S. PATENT DOCUMENTS 1,762,766 6/1930 Garay ..... 285/398 X 3,762,343 10/1973 Thacker ..... 108/53.3

3,857,494 12/1974 Giardini ..... 108/53.5 X 3,865,250 2/1975 Jay ..... 108/53.5 X 4,053,247 10/1977 Marsh ..... 285/398 X

*Primary Examiner*—Andrew V. Kundrat

*Attorney, Agent, or Firm*—Kirkland & Ellis

[57] ABSTRACT

A stackable container which is capable of being knocked down or taken apart is provided with connection joints used to assemble the container. The connection joints have an outer support collar and an inner support guide which combine to translate bending forces, produced in use, along the length of the container support columns. When being transported without a load, the container can be disassembled (i.e. knocked down) to reduce shipping costs.

8 Claims, 2 Drawing Sheets

KNOCK-DOWN STACKABLE CONTAINER

BACKGROUND OF THE INVENTION

1. Field of the Invention

This invention is in the field of shipping and storing equipment. Specifically it relates to collapsible stackable shipping and storing containers.

2. Background Information

This invention relates to a stackable container which has the ability to be a "knock down" container. By "knock down", it is meant that the container can be taken apart, into several different pieces. However, the container can still be easily reassembled. This ability gives the container the important feature of being shipped in pieces which greatly reduces freight costs for unassembled containers.

The problem of high freight costs for shipping an empty or newly completed stacking containers has existed for many years. Units have been previously manufactured to take advantage of the knock down feature, however none of them have been able to meet the Rack Manufacturers Institute standards for dynamic loading. Basically this means that when assembled, the knock down containers were either too shaky or could not support enough weight to be useful to industry.

One clear example of the problem is displayed in U.S. Pat. No. 3,762,343 to Thacker. As part of the Thacker disclosure and claims, a knock down stackable container is discussed. The Thacker patent teaches that to make a knock down unit, short lengths of corner columns are welded to the deck members and the top frame. Upright posts are designed with integral, inwardly projections which extend from the inside the upright posts into the deck and top frame corner columns. This structure, when constructed of tubing similar to the balance of the container, does not provide the necessary structural integrity. As a result, the Thacker knock down container is not used by industry. A continued search exists for a knock down container which meets the Rack Manufacturers Institute (RMI) standards (RMI Paragraph 8.2.2 "Stacked Load Capacity Test") and can withstand the use in industry.

The principle problem in producing a knock down container which meets the RMI standards is column loading. There are two types of stresses which affect the columns, axial and bending. The axial stresses are developed from loaded containers being stacked directly above one another, however, these stresses are minor. The majority of the stress is caused by bending moments on the columns. The columns must withstand both manufacturing misalignments and, more severely, a required RMI 3% grade design specification. Visually, this means that a lower most loaded knock down container must be able to withstand being placed at a 3% grade with 3 or 4 fully loaded knock down containers placed on top of the first container. The standard is important because it insures integrity of stackable containers by assuring that the lower most container will not collapse due to the demanding stresses developed from any movement of loads which are supported by and above the lower most unit. A 3% grade produces a bending force which current knock down container designs cannot withstand.

With currently designed knock down containers the bending forces have generally buckled the connection joint between the container top and the column or, more typically, between the container deck and the column. This means that in service the currently designed knock down containers actually collapse at the joints. Thus, it this connection joint that has been reinvented.

In view of the above problems, it a principle object of this invention to provide a knock down stackable container which meets the RMI standards. It is a further object of this invention to provide a knock down stackable container with a connection point between the top of the container and the column and between the deck of the container and the column which resists bending forces.

In the most preferred embodiment and end nesting stackable container is used and not only a stacking container. An end nesting stackable container is one which fits inside other like containers yet also stacks one on top of another. This combination of features allows for ease in shipping and storing material held in the containers by use of the stacking feature. Also the containers may be cost effectively shipped empty by use of the nesting feature because many empty nested containers take only the space of one filled container. Thus, the knock down end nesting stackable container would provide the greatest flexibility in shipping and storing material known to date.

SUMMARY OF THE INVENTION

A knock down stackable container is provided with a connection joint which allows the columns of the container to be removably attached to the container top frame and the deck of the container. The connection joint has a first portion attached to the container frame and a second portion attached to each end of the at least four support columns. The container frame portion of the joint is a column support tube. The column portion of the connection joint comprises an outer support means, an inner support means and a column portion. The outer support means is a collar which is attached to the outer face of the column and slides over the column support tube. The inner support means is an inner support guide, informally called a "stuffer", which is attached to the inside face of the column, yet projects beyond the end of the column. This projection slides into the column support tube. A principle feature of this invention is that the column portion of the connection joint and the container frame portion of the connection joint fit snugly together over an extended length.

The most preferred embodiment of this invention is where the stackable container is also end nesting.

BRIEF DESCRIPTION OF THE DRAWINGS

The objects and advantages of the present invention will be better understood from a reading of the following detailed description in conjunction with the accompanying drawings in which.

DETAILED DESCRIPTION

This invention stems from the failure of the knock down end nesting stackable container to perform satisfactorily in practice. As such, it incorporates the disclosure of U.S. Pat. No. 3,762,343 to Thacker, which is herein incorporated by reference. However, the invention herein comprises many new features not known before in the art of stackable containers.

Figure 1:
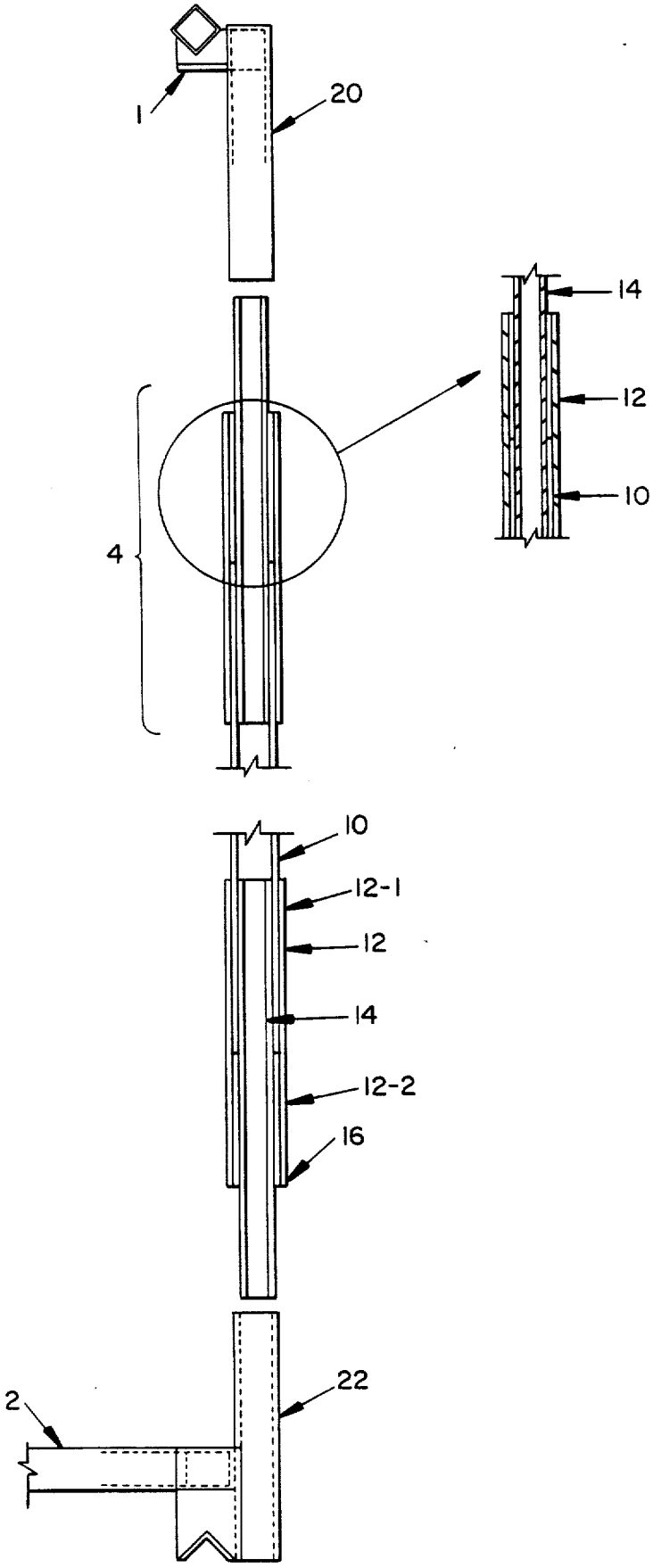
FIG. 1 shows the column with the connection joint in position to assemble the container.

Referring to the drawings, FIG. 1 shows the column 10 in position to connect the top frame 1 to the bottom deck 2. The connection of the column to the top frame and the bottom deck is accomplished by the connection joint. The connection joint has a frame portion 20 or 22 and a column portion 4 at each end of the column 10. The column connection joint portion is identical at each end thereby eliminating any problem concerning which end connects to the top frame or the bottom deck.

Looking at the specifics of the column portion of the connection joint, FIG. 1 shows that there is an inner support means, an outer support means and a column portion to the joint. The inner support means is an inner support guide 14 which is hereinafter called the "stuffer". The stuffer 14 is attached to the inside of the column 10 and extends out beyond the end of the column. To allow for this feature the column is a tube with through openings having an inside face and an outside face. The stuffer is attached to the inside face.

It should be noted that the stuffer length is related to the stress requirements of the specific container. In use, a knock down stackable container will have dynamic stress applied to the connection joints. The stress levels vary with the container size, namely, the taller the container, the higher the stress level and the longer the stuffer. The longer stuffer is necessary to transfer dynamic stresses throughout the column as opposed to allowing the stresses to concentrate in a limited area where the column is connected to the container frame itself.

The cross-sectional shapes of the column and the stuffer must be compatible because the stuffer must interface with the column in a manner to receive and translate the dynamic stresses. Therefore, the stuffer will either be the same cross-sectional shape as the column or it will be an "X" member or a cross member or other cross-sectional shape sufficient to perform the above described function.

Figure 2:
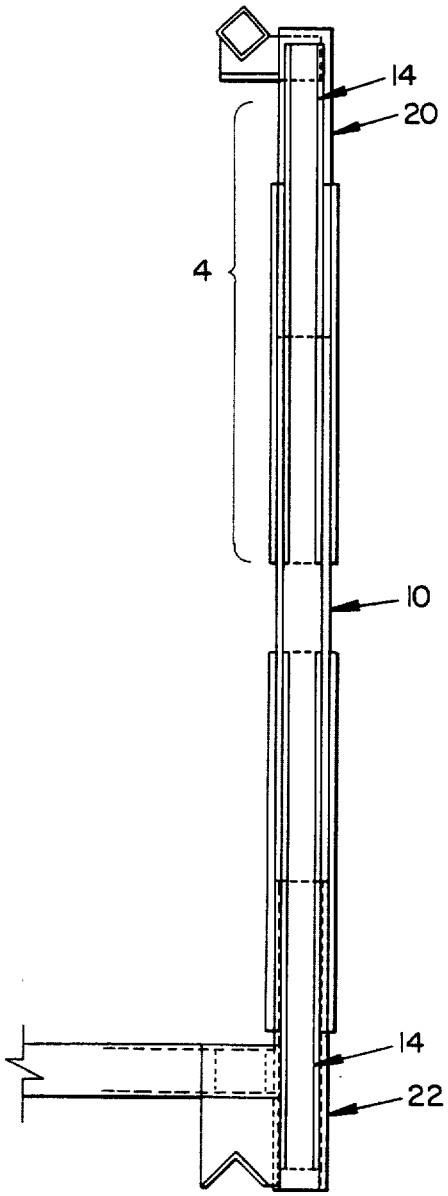
FIG. 2 shows the column assembled with the top frame and the bottom deck.

To fully perform its function, the stuffer 14 is inserted into a column support tube 20 or 22. Since the column portion of the connection joint is identical at both ends of the column, it does not matter which end goes into the upper column support tube 20 or into the lower column support tube 22. However, it should be noted that the upper and lower column support tubes are not identical. Specifically, the lower column support tube 22 is stronger than the upper column support tube 20 because it supports more of the load. As shown in FIG. 2, when the stuffer 14 is inserted into the column support tube 20 or 22, it beneficially engages the entire length of the tube. This allows translation of as much of the dynamic stresses as possible.

Also, this invention has lengthened both column support tubes 20 and 22 beyond that known previously in the art. The increased length beneficially provides redistribution of the bending stresses from concentration on the column to frame or deck weldment to the entire length of the column support tube.

Referring back to FIG. 1, the second major support means is the outer support means which is embodied in this case by a collar 12. The collar 12 has two sides: the first side of the collar 12-1 is the side that fits around the outer face of the column and the second side of the collar 12-2 is the side that slides over a column support tube 20 or 22. It should be clear that the second side of the collar 12-2 is the side that extends beyond the column portion of the connection joint, thus allowing it to slide over the column support tube. The second support means, namely the collar 12, acts as a final interface stress distributor, thereby giving greater stability to the knock down container.

Also shown in FIG. 1 is the swage opening 16 of the collar 12 which is located at the end of the second side of the collar 12-2. This swage opening 16 provides lead-in guide alignment when the connection joint is being assembled.

Another aspect of the collar 12 to column 10 relationship is their relative cross-sectional shapes. The collar cross-sectional shape is typically identical to that of the column. However, one of skill in the art would know that any relative cross-sectional shapes could be used should they satisfy the structural requirements described herein. The main objective in selecting an appropriate cross-sectional shape is to provide sufficient receipt and transfer of the dynamic stresses. Additionally note that the tubing is selected to provide the closest possible fit of the connection joint without interference.

Looking now at FIG. 2, there is shown a stackable container portion employing the connection joint 4 of the present invention. The connection joint 4 extends over a majority of the length of the column 10, thereby providing strength and rigidity against both axial and bending stresses.

As explained in detail above , the connection joint receives support from a combination of features, namely an outer support means and an inner means. It is this combination of features which was not heretofore known in the art of stackable containers.

Thus, while specific embodiments of the present invention have been described above in detail, it will be understood by one of ordinary skill in the art that this description is to be considered in all senses illustrative rather than restrictive. Those skilled in the art will recognize other embodiments and modifications of the present invention, the scope of which is delimited solely by the following claims.

We claim:

1. A stackable container, adapted to be shipped in a knock down condition, comprising:

a top frame;

a bottom deck;

at least four columns being tubular members with through openings having an inside face and an outside face;

wherein the columns detachably connect the top frame to the bottom deck using a connection joint;

wherein the connection joint comprises a column portion and a top frame or a bottom deck portion;

wherein there is a column connection joint portion at each end of each column, a first column connection joint portion to connect to the top frame portion and a second column connection joint portion to connect to the bottom deck;

wherein the top frame or bottom deck connection joint portion comprises a column support tube being a tubular member with a through opening; and wherein the column connection joint portion comprises an inner support, means, an outer support means and a column portion coaxially therebetween.

2. A stackable container as in claim 1, wherein the inner support means is an inner support guide which is firmly attached to the inside face of the column while projecting out the end of the column portion and is adapted to slide into the column support tube.

3. A stackable container as in claim 2, wherein the inner support guide has a cross sectional configuration selected from the group consisting of a cross sectional configuration identical to the column, a cross member, and other cross sections of sufficient rigidity and strength to provide a strong container which resists bending moments.

4. A stackable container as in claim 1, wherein the outer support means is a collar which is firmly attached to the outside face of the column at the first side of the collar and extends beyond the end of the column portion at the second side of the collar; wherein the second side of the collar is adapted to slide over the column support tube.

5. A stackable container as in claim 4, wherein the end of the second side of the outer column collar is adapted to allow ease in connecting the column to the top frame or bottom support.

6. A stackable container as in claim 5, wherein the end of the second side of the collar has a swage opening.

7. A stackable container as in claim 1, wherein the assembled container is capable of withstanding a 3% grade when fully loaded with similar fully loaded stackable containers above it.

8. An end nesting stackable container, adapted to be shipped in a knock down condition, comprising:

a top frame;

a bottom deck;

at least four columns being tubular members with through openings having an inside face and an outside face;

wherein the columns detachably connect the top frame to the bottom deck using a connection joint;

wherein the connection joint comprises a column portion and a top frame or a bottom deck portion;

wherein there is a column connection joint portion at each end of each column, a first column connection joint portion to connect to the top frame portion and a second column connection joint portion to connect to the bottom deck;

wherein the top frame or bottom deck connection joint portion comprises a column support tube being a tubular member with a through opening; and wherein the column connection joint portion comprises an inner support means, an outer support means and a column portion coaxially therebetween.

* * * * *